United States Patent [19]

Langen et al.

[11] Patent Number: 4,642,975

[45] Date of Patent: Feb. 17, 1987

[54] CARTON LOADING MACHINE

[75] Inventors: Marinus J. M. Langen, Toronto; Peter Guttinger, Milton, both of Canada

[73] Assignee: H. J. Langen & Sons Limited, Mississauga, Canada

[21] Appl. No.: 825,147

[22] Filed: Feb. 3, 1986

[51] Int. Cl.[4] ..... B65B 43/28; B65B 43/52

[52] U.S. Cl. ..... 53/564; 198/836; 493/479

[58] Field of Search ..... 53/564, 566; 493/318, 493/319, 479, 478; 198/836

[56] References Cited

U.S. PATENT DOCUMENTS

| | | | |
|---|---|---|---|
| 2,390,107 | 12/1945 | Kucklinsky | 493/479 X |
| 2,896,520 | 7/1959 | Woelfer | 493/319 X |
| 2,984,162 | 5/1961 | Gordon | 493/319 X |
| 3,626,656 | 12/1971 | Langenscheidt | 198/817 X |
| 4,089,150 | 5/1978 | Heisler | 493/479 X |

*Primary Examiner*—James F. Coan

*Attorney, Agent, or Firm*—Fetherstonhaugh & Co.

[57] ABSTRACT

A carton loading machine has an endless carton conveyor which extends in a horizontal path which in plan view extends in a generally square configuration. A plurality of carton receptacles are mounted on the endless conveyor for movement therewith. Retainer bars are arranged opposite the open ends of the receptacles along at least three sides of the square configuration of the path and these retainer bars are mounted for simultaneous movement with respect to the receptacles so that the space between the retainer bar and the oppositely disposed wall of the receptacle can be adjusted to accommodate articles of different sizes. A further retainer bar is located below the open lower end of the receptacles and extends along at least two sides of the square configuration of the conveyor path. These second retainer bars are also simultaneously adjustable in height with respect to the receptacles so as to accommodate cartons of different length in the receptacles.

13 Claims, 12 Drawing Figures

CARTON LOADING MACHINE

FIELD OF INVENTION

Figure 1:
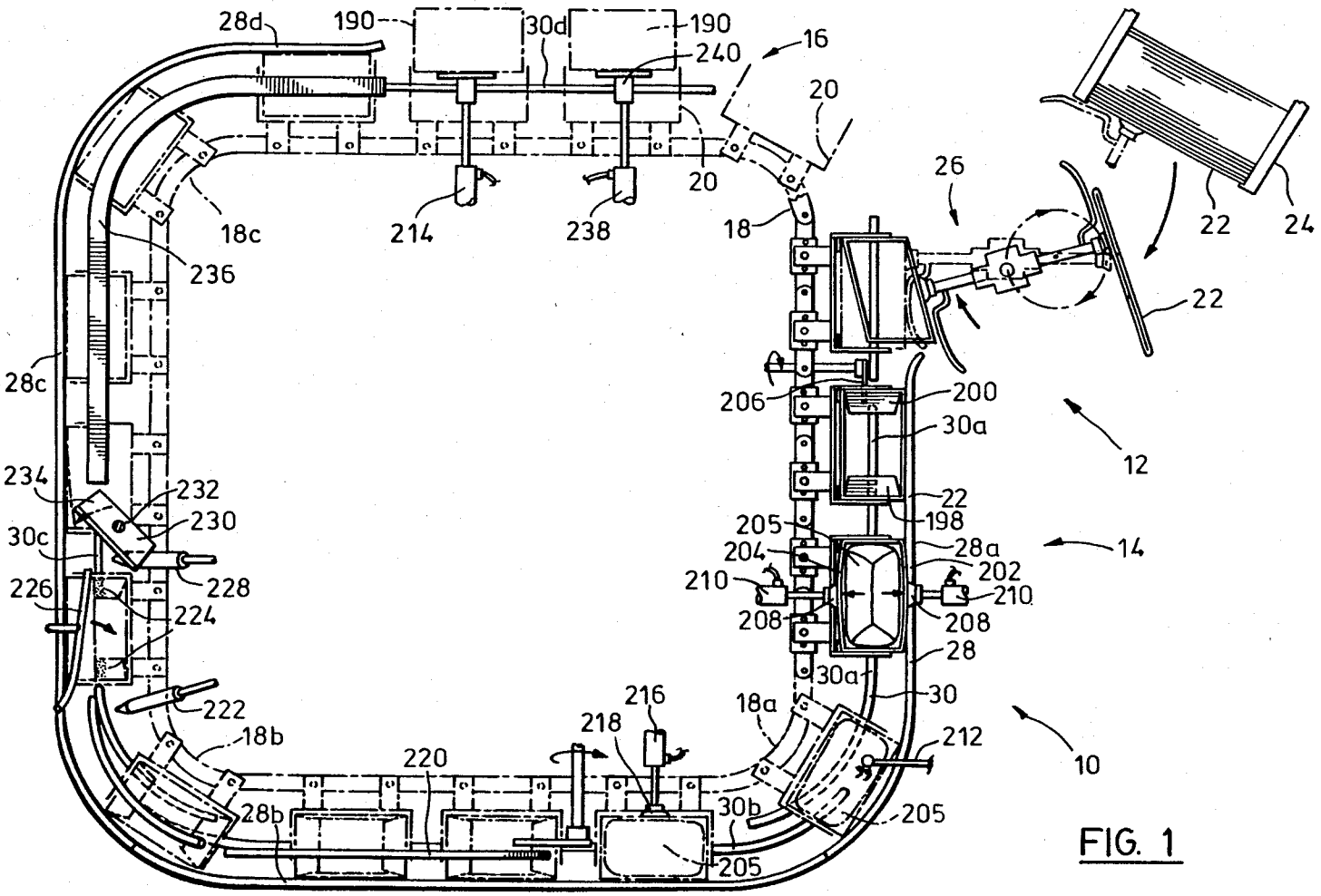

This invention relates to carton loading machines.

In particular, this invention relates to improvements in carton loading machines which facilitate the adjustment of the machine to accommodate cartons of different sizes.

PRIOR ART

In carton loading machines, it is frequently necessary to interrupt the operation of the machine in order to make the adjustments necessary to permit the machine to be used for loading cartons of a different size. The downtime in such an operation is expensive and can cause undesirable interruptions in the flow of product which might otherwise be continuous. These difficulties are encountered in the packaging of products such as cereal products in which pouches containing the cereal product are loaded into a paperboard carton which is subsequently closed and sealed.

The proportions of cartons for cereal products and the like may vary in width, back-to-back depth and in height and difficulty is frequently experienced in adjusting the various guide bars which are used in conventional carton loading machines to accommodate these products of different proportions. Frequently, there are several different guide bars which must be adjusted in order to accommodate the cartons of different size and difficulty is experienced in making the required adjustments.

Generally, carton loading machines employ a conveyor which is longitudinally elongated so that the machines have a considerable length. Each of the various operations between the loading and the discharging of the cartons is carried out at different points along the length of the loading machine. Because there are a large number of steps to be performed in such an operation, these machines are frequently quite long, measuring upwards of 30 feet in length. Large machines of this type are difficult to accommodate in many packaging installations where the primary machinery is that required in order to produce the product which is to be packaged.

SUMMARY OF INVENTION

It is an object of the present invention to provide a carton loading machine which can be easily adjusted to accommodate cartons of different size.

It is a further object of the present invention to provide a carton loading machine which is compact and which is not longitudinally elongated.

It is yet another object of the present invention to provide a carton loading machine which is compact and in which the various adjustable guide rails can be simultaneously adjusted to accommodate cartons of different proportions.

According to one aspect of the present invention there is provided in a carton loading machine in which cartons are vertically oriented and upwardly open when loading, the loading machine having a carton receiving station and a carton discharge station, the improvement of an endless carton conveyor extending in a generally horizontal plane along an endless path from the receiving station to the discharge station and back to the receiving station, a plurality of carton receptacles mounted on said endless conveyor for movement therewith along said path, each receptacle having an open front end opening laterally from said path, a plurality of first retainer members arranged in an overlapping end-to-end relationship extending along said path between said receiving station and said discharge station and disposed opposite the open ends of said receptacles for retaining an open carton in said receptacles in use, mounting means mounting said first retainer members for simultaneous movement of said first retainer members with respect to said receptacles for movement toward and away from the open front ends thereof to accommodate cartons of different front to back width.

According to a further aspect of the present invention, there is provided in a carton loading machine in which cartons are vertically oriented and upwardly open when loading, the loading machine having a carton receiving station and a carton discharge station, the improvement of a carton conveyor system comprising a main frame, an endless conveyor mounted on the main frame and extending in a generally horizontal plane along an endless path from the receiving station to the discharge station and back to the receiving station, a plurality of carton receptacles mounted on said endless conveyor for movement therewith along said path, each receptacle having an open front end opening laterally from said path and an open bottom end opening downwardly from said conveyor, a secordary frame, first mounting means mounting said secondary frame onto the main frame for relative movement with respect to the main frame so as to be adjustable in height with respect to said conveyor, first retainer means spaced laterally from and disposed opposite said conveyor for laterally retaining items on said conveyor, second mounting means mounting said first retainer means on said secondary frame for simultaneous lateral adjustment with respect to said conveyor means to accomodate items of lateral proportion, second retainer means carried by said secondary frame and located below the open bottom ends of said recepticles between said loading and discharge stations, said second retainer means moving with said secondary frame in response to operation of said first mounting means to vary the height of the secondary retainer means with respect to said conveyor to accomodate items of different height carried by said conveyor.

According to yet another aspect of the present invention, there is provided in a carton loading machine in which cartons are vertically oriented and upwardly open when loading, the loading machine having a carton receiving station and a carton discharge station, the improvement of a carton conveyor system comprising a main frame having a generally quadrilateral shape in plan view, an endless conveyor mounted on the main frame and extending in a generally horizontal plane along an endless path from the receiving station to the discharge station and back to the receiving station, said endless path having four straight lengths interconnected by rounded corners so as to correspond to the generally quadralateral shape of the main frame, a plurality of carton receptacles mounted on said endless conveyor for movement therewith along said path, each receptacle having an open front end opening laterally from said path and an open bottom end opening downwardly from said conveyor, a secondary frame having a generally quadrilateral shape in plan view corresoonding to the that of the main frame, a jacking screw component mounted for rotation at each corner of said secondary frame, a jacking nut mounted for rotation at each corner of said main frame, each jacking nut threadedly receiving a jacking screw so as to mount said secondary frame for vertical movement with respect to said main frame so as to be adjustable in height with respect to said conveyor, a sprocket mounted on each jacking screw, a chain drivingly engaging each of said sprockets such that rotation of one jacking screw causes rotation of all of the jacking screws to evenly adjust the height of the secondary frame, a support member extending along each side of said secondary frame, a rack member located at each end of each support member, the rack members of each support member extending parallel to one another and forming a set, a pinion member mounted for free rotation on each of said jacking screws, one rack member of each set of rack members being located adjacent a rack member of an adjacent guide rail to provide adjacent pairs of rack membets, the rack members of each adjacent pair being meshed with one of said pinions such that all of the rack and pinion members are drivingly interconnected so that rotation of one of said pinions causes all of the support members to move laterally simultaneously with respect to said conveyor, a first retainer member mounted on each support member and spaced laterally from and disposed opposite said open front ends of said recepticles for laterally retaining items in said recepticles, said first retainer means moving with said support means both laterally and vertically so as to adjust all of the first retainers simultaneously as recuired in use, second retainer means mounted on each support member and located below the open bottom ends of said recepticles to provide underlying support for items in said recepticles, as they travel between said loading and discharge stations, said second retainer means moving with said secondary frame in response to operation of said jacking screws to vary the height of the second retainer means with respect to said conveyor to accommodate items of different height carried by said conveyor.

Figure 2:
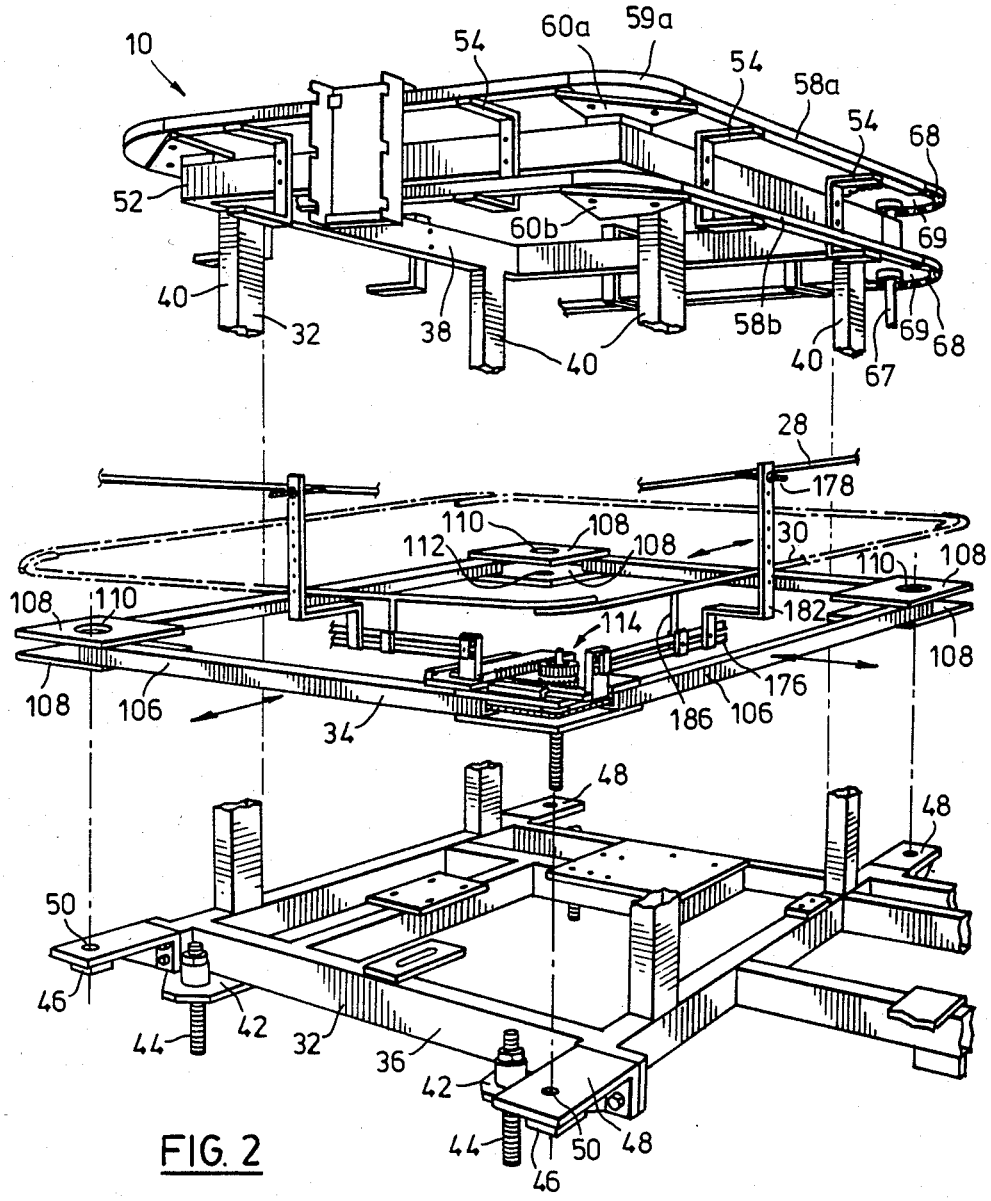
Figure 3:
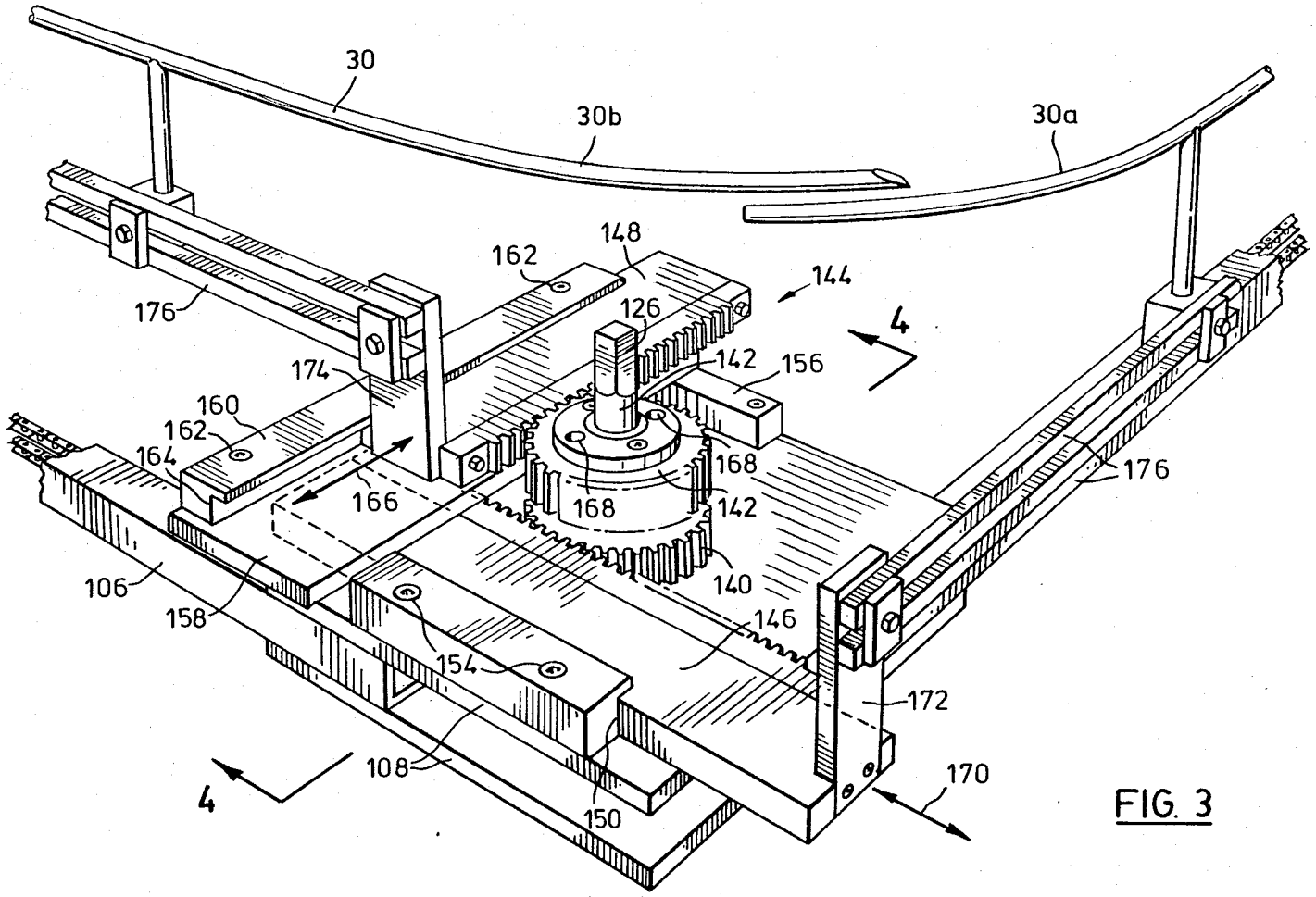
Figure 4:
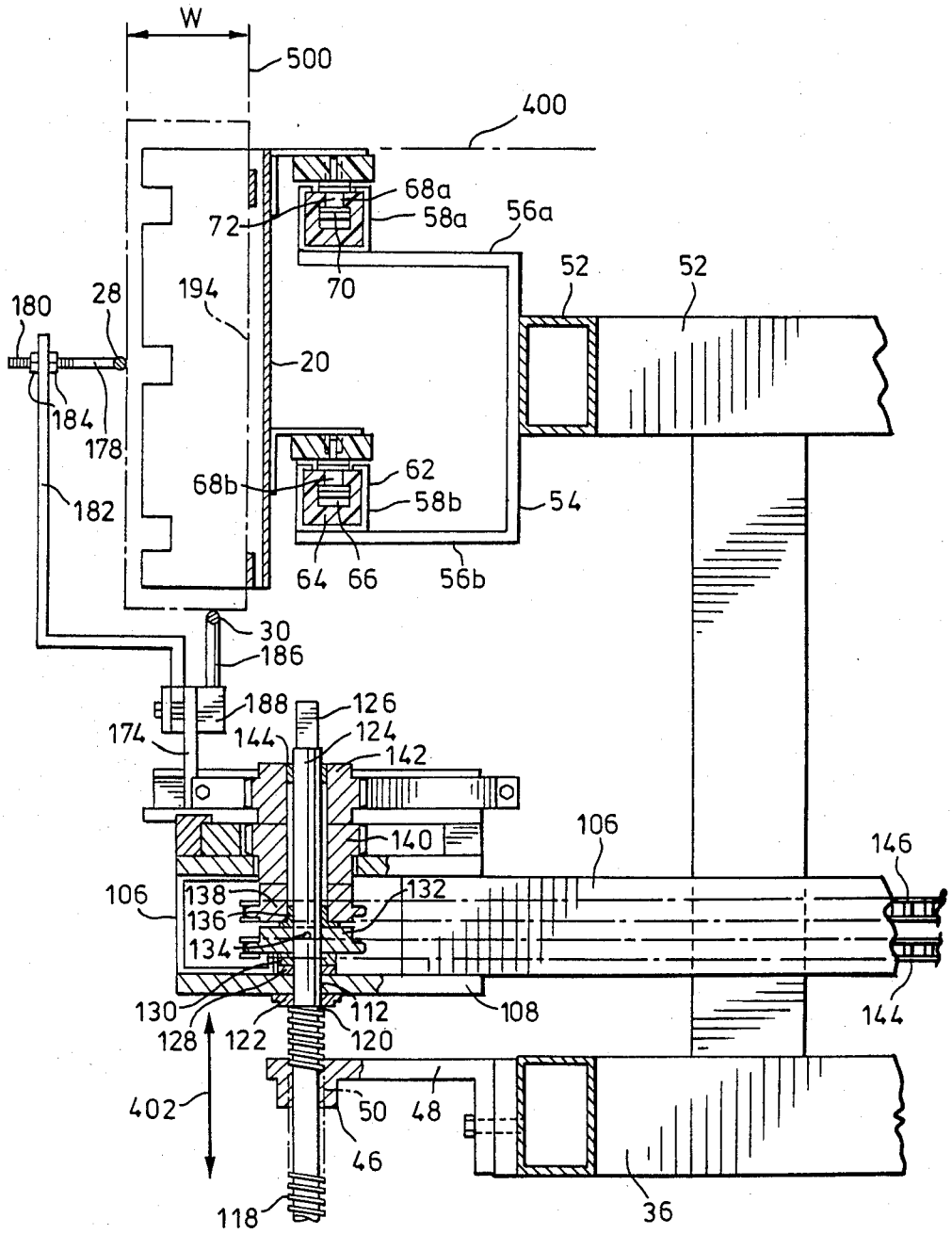
Figure 5:
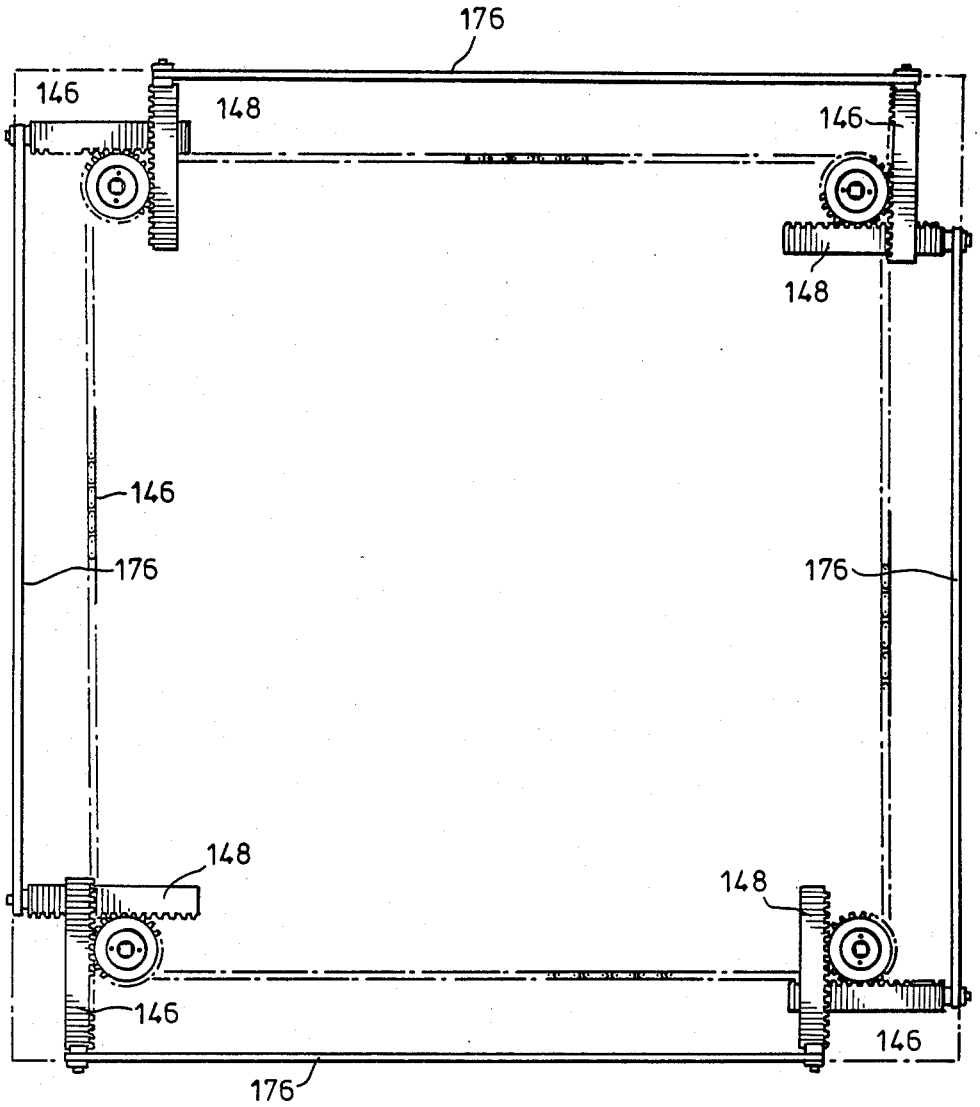
Figure 6:
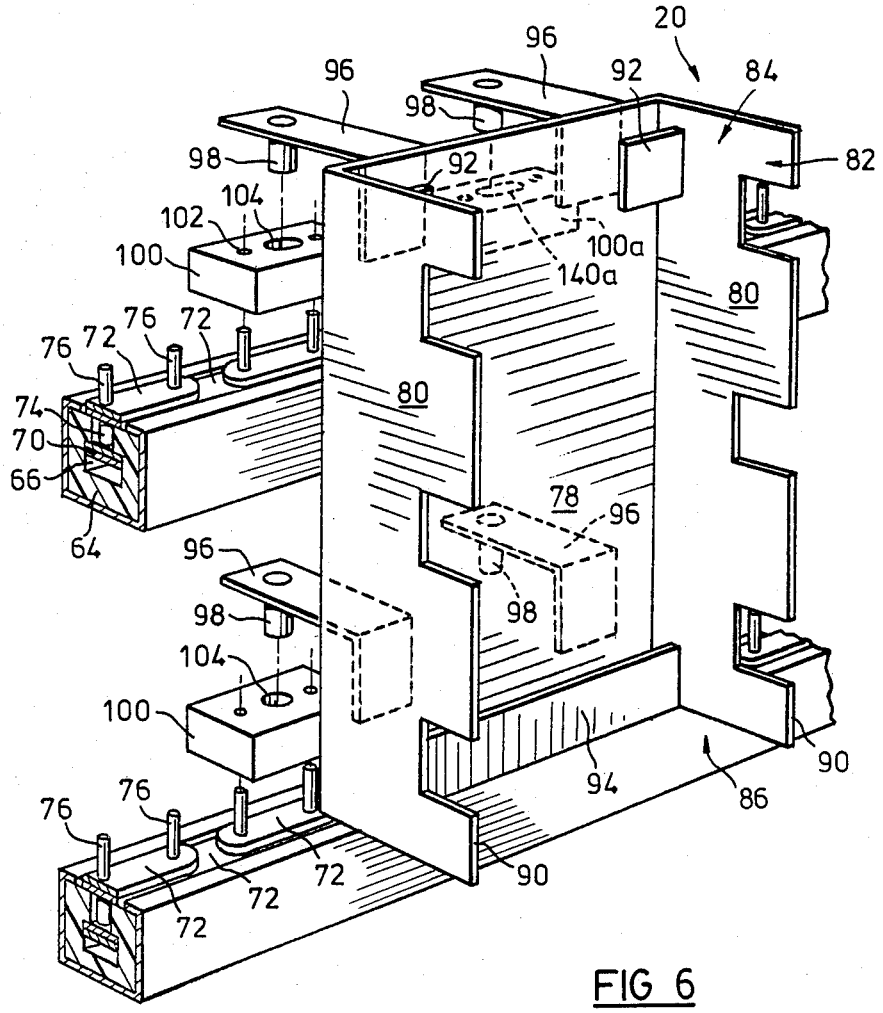
Figure 7:
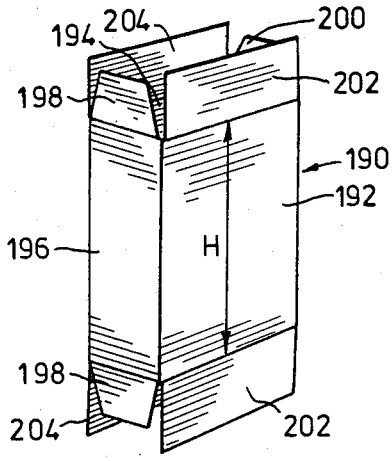
Figure 8:
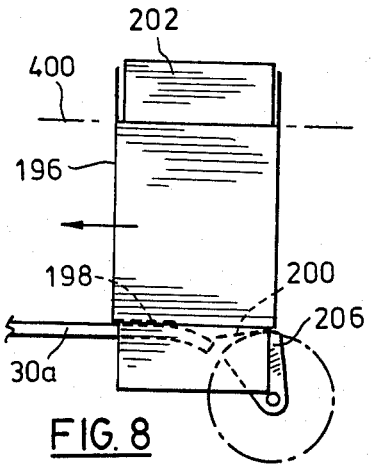
Figure 9:
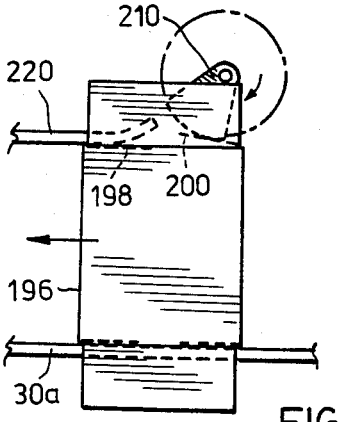
Figure 10:
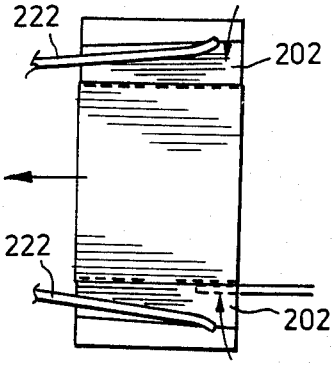
Figure 11:
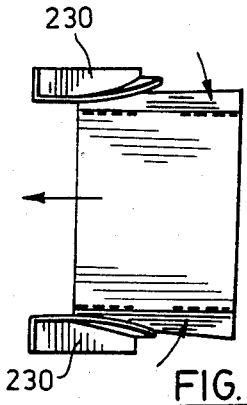
Figure 12:
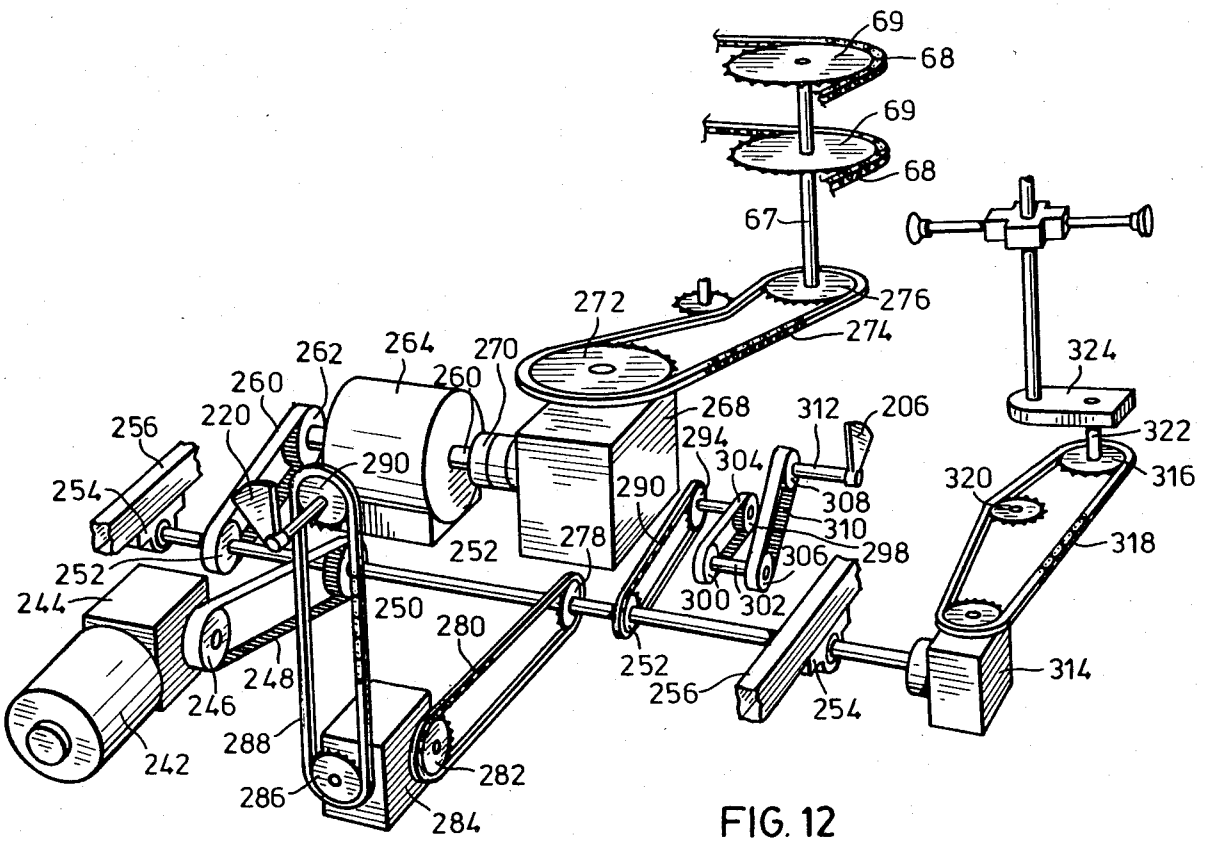

The invention will be more clearly understood after reference to the following detailed specification read in conjunction with the drawings wherein;

FIG. 1 is a plan view of a carton loading machine constructed in accordance with an embodiment of the present invention, FIG. 2 is a partially sectioned exploded view of a carton loading machine, FIG. 3 is an enlarged detail of the lateral adjustment mechanism, FIG. 4 is a sectional view taken along the line 4—4 of FIG. 3, FIG. 5 is a diagrammatic plan view illustrating the lateral adjustment mechanism, FIG. 6 is a partially exoloded pictorial view illustrating the mounting of a receptacle on the conveyor, FIG. 7 is a pictorial view of a carton arranged in an open configuration, FIG. 8 is a side view of the carton of FIG. 7 showing a first step in the closing of the bottom of the carton, FIG. 9 is a view similar to FIG. 8 showing a first step in the closing of the top of the carton, FIG. 10 is a view similar to FIG. 8 showing a further step in the closing of the carton, FIG. 11 is a view similar to FIG. 10 showing yet another step in the closing of the carton, and FIG. 12 is a pictorial view of the drive train which illustrates that the various power take-offs are taken from a single jack shaft.

With reference to FIG. 1 of the drawings, the reference numeral 10 refers generally to a carton loading machine constructed in accordance with an embodiment of the present invention. The carton loading machine 10 has a carton receiving station 12, a carton loading station 14 and a carton discharge station 16. An endless conveyor 18 extends continuously from the carton receiving station through the carton loading station and through the carton discharge station back to the carton receiving station. The conveyor 18 extends in a generally horizontal plane along an endless path which is substantially square in plan view as illustrated in FIG. 1. The endless path has four straight lengths which are connected at rounded corners.

Carton receptacles 20 are mounted on the conveyor 18 at spaced intervals along the length thereof. Cartons 22 are stored in a knock-down configuration in a storage magazine 24. A transfer mechanism 26 is provided for the purposes of withdrawing a knock-down carton 22 from the storage magazine 24 and transferring it to successive receptacles 20 to locate the carton in an open configuration in the receptacles 20 as the receptacles are driven through the carton receiving station 12.

The transfer mechanism 26 is constructed substantially in accordance with the structure described in U.S. Pat. No. 3,937,458 dated Feb. 10, 1976 and assigned to H. J. Langen & Sons Limited and will not therefore be described in detail.

The cartons 22 which are the items which are housed in the receptacles 22 are retained against lateral movement out of the receptacles 22 during passage from the receiving station to the discharge station by means of a first retainer bar 28 which has sections 28*a*, 28*b*, 28*c* and 28*d* which overlap one another at the corners 18*a*, 18*b* and 18*c* of the conveyor 18. A second retainer bar 30 extends below the receptacles and has sections 30*a*, 30*b*, 30*c* and 30*d* which underlie the receptacles.

With reference to FIG. 2 of the drawings, it will be seen that the carton loading machine 10 comprises a main frame 32 and a secondary frame 34. The main frame 32 has a base portion 36 which is connected to an upper portion 38 by means of four upright posts 40. Feet 42 are located one at each corner of the base portion 36 and have levelling screws 44 mounted therein. Jacking nuts 46 are mounted one on each bracket 48 which is located at each of the four corners of the base portion 36 of the main frame 32. A threaded passage 50 extends through the brackets 48 and jacking nuts 46.

The upper portion 38 of the frame consists of four box shaped frame members 52 which are secured to the upper ends of the upright posts 40 and which extend in a generally square configuration when viewed in plan view. A plurality of U-shaped brackets 54 are mounted on the frame members 52. The U-shaped brackets 54 have arm portions 56*a* and 56*b* which project laterally outwardly. Chain guides 58*a* and 58*b* are mounted on the arm portions 56*a* and 56*b* respectively and extend about the upper end of the frame. Corner plates 60*a* and 60*b* serve to support rounded corner portions 59*a* and 59*b* which connect the straight length portions 58*a* and 58*b* respectively. The chain guides 58 and 59 each comprise a metal jacket 62 within which a plastic slide member 64 is located. A T-shaped slot 66 is formed in the slide member 64 and extends longitudinally thereof. Chains 68*a* and 68*b* are mounted on the slide members 64. The chains 68*a* and 68*b* each comprise a series of links 70 and a series of links 72 which are connected by rollers 74 which have pins 76 projecting outwardly from the links 72. The chains 68*a* and 68*b* are slidably mounted in the slide members 64 by locating the links 70 within the enlarged inner portion of the T-shaped slot 66 as shown in FIGS. 4 and 6 of the drawing. The chains 68*a* and 68*b* are engaged by sprockets 69 which are mounted on a drive shaft 67 which forms a part of the power train which will be described hereinafter with reference to FIG. 12.

With reference to FIG. 4 of the drawings, it will be seen that the carton receptacles 20 each have a U-shaped body portion which consists of an inner panel 78 and a pair of oppositely disposed side panels 80. Each receptacle has an open front end 82, an open top end 84 and an open bottom end 86. Three sets of U-shaped notches 88 are formed along the outer edges 90 of the side panels 80.

The carton receptacles 20 each have small insert panels 92 which are located adjacent the upper end thereof and an insert panel 94 which is located adjacent the lower end thereof and extends laterally between the side panels 80. The inset panels 92 and 94 serve to space the adjacent wall of the carton from the inner panel 78 of the receptacle 20 so as to provide a clearance which is used to accommodate the bowing of the side wall of the carton which occurs when the suction cups 208 are applied thereto as shown in FIG. 1 of the drawings.

L-shaped brackets 96 are mounted on the back face of the inner panel 78 and project outwardly therefrom. Pins 98 extend downwardly from the brackets 96. Mounting blocks 100 are provided for the purposes of releaseably securing the carton receptacles 20 to the endless conveyor 18. Each of the mounting blocks 100 is formed with two mounting passages 102 which are proportioned and arranged to receive the pins 76 which project from the links of the conveyor chain. A further mounting passage 104 is formed in each of the mounting blocks 100 and is proportioned to receive the pins 98 of the carton receptacles. It will be noted that the passage 104*a* which is formed in the trailing mounting block 100*a* is longitudinally elongated so as to permit longitudinal movement of the pin 98 mounted in the slot 100*a* sufficient to permit the chain to negotiate the rounded corners.

Secondary Frame

With reference to FIGS. 2 to 5 of the drawings, it will be seen that the secondary frame 34 comprises four tubular members 106 which are arranged in a generally square configuration corresponding to that of the main frame and which are interconnected at adjacent ends by square shaped corner plates 108. Passages 110 open through the upper corner plate 108 and passages 112 which are of smaller diameter open through the lower corner plate 108.

A jacking screw 116 is formed with threads 118 at its lower end and is threadedly mounted in the jacking nut 46. A shoulder 120 is formed at the upper end of the threaded portion of the jacking screw and bears against a thrust bearing 122. The jacking screw 116 has a stem portion 124 which extends upwardly from the shoulder 120 and terminates in a square end portion 126. A thrust bearing 128 is mounted on the stem portion 124 and located in a face-to-face relationship with respect to the lower corner plate 108. A further thrust bearing 130 is located in a face-to-face relationship with respect to the thrust bearing 128. A sprocket 132 is secured to the stem 124 by means of a pin 134 so as to be rotatable with the stem 124. A further bearing 136 is mounted on the stem 124 so as to be positioned between a further sprocket 138 and the sprocket 132 and between a further sprocket 138 and the stem 124, so as to permit free rotation of the sprocket 138 with respect to the stem 124 and the sprocket 132. The sprocket 138 is connected to a pinion 140 which is connected to a further pinion 142. A sleeve bearing 144 is located between the pinion 142 and the stem 124. The sprocket 138, pinion 140 and pinion 142 are interconnected so as to rotate as a unit with respect to the stem 124 on bearings 138 and 144. A chain 144 drivingly connects each of the sprockets 134 and a chain 146 drivingly connects each of the sprockets 138. The chains 144 and 146 extend through the channels formed in the tubular members 106.

With reference to FIG. 3 of the drawings, it will be seen that the lateral adjustment mechanism which is generally identified by the reference numeral 144 includes rack members 146 and 148 which extend at right angles to one another and are arranged to mesh with the pinions 140 and 142 respectively. The rack member 146 is secured in a sliding relationship with respect to the pinion 142 by a mounting block 152 in which a slipway recess 150 is formed. The mounting block 152 is secured to the upper corner plate 108 by mounting screws 154. A spacer block 156 is mounted on the upper corner plate 108 and extends upwardly therefrom to a height which is substantially equal to the height of the rack member 146. A platform 158 has one end secured to the spacer block 156 and extends across the upper surface of the rack member 146. A mounting block 160 is secured to the platform 158 by mounting screws 162 and has a slipway notch 164 extending along the inner face thereof. The rack 148 is slidably mounted in the slipway 146 for movement to and fro in the direction of the arrows 166 and is meshed with the sprocket 142. Sockets 168 are formed in the upper face of the sprocket 142. With the aid of a manually engagable tool (not shown) which has pins which will fit in the sockets 168, it is possible to rotate the sprocket 142 about the stem 124 thereby causing the rack 148 to move to and fro in the direction of the arrows 166 as previously described. Because the sprocket 140 is held fast with respect to the sprocket 142, the same action will cause the rack member 146 to slide to and fro in the directions 170.

Upright posts 172 and 174 are mounted on and project upwardly from the rack members 146 and 148 respectively. Guide rails 176 extend between the uprights posts 172 and 174.

The first retainer bars 28 are mounted on adjustment arms 178 which have a threaded portion 180 which extends through a passage formed in a bracket 182. Adjustment nuts 184 are mounted on the threaded portion 180, one on either side of the bracket 182 to provide for limited alignment adjustment of the first retainer bar 28. The brackets 182 are mounted on the guide rails 176 for movement therewith.

The second retainer rails 30 have support posts 186 which extend downwardly therefrom and are mounted on mounting blocks 188 which are secured to the guide rails 176 in a conventional manner.

A typical carton of the type which is loaded in the carton loading machine of the present invention is illustrated in FIG. 7 of the drawings and generally identified by the reference numeral 190. The carton 190 has a front wa11 192, a back wall 194 and a pair of oppositely disposed side walls 196, leading end flaps 198 project upward1v from one of the side walls 196 and trailing end flaps 200 project from the other side wall 196. First side flaps 202 project from the front wall 192 and second side flaps 204 project from the back wall 194.

The sequence of events in the closing of the end flaps of the carton will now be described with reference to FIGS. 8 to 11 of the drawings. As shown in FIG. 8 of the drawings, the leading end flap 198 at the lower end of the carton is initially folded upwardly by engagement with the leading end of the second retainer bar 30*a* and a trailing end flap 200 is folded upwardly by engagement with the kicker blade 206.

To facilitate the introduction of the package 205 which contains the goods which are to be shipped in the carton, suction cups 208 are moved into engagement with the side flaps 202 and 204 which project upwardly from the side walls and the cylinders 210 which are ooerable to move the suction cups toward and away from the flaps 202 and 204 are initially activated to move the flaps 202 and 204 away from one another to enlarge the opening in the upper end of the carton to facilitate the entry of the package 205. Thereafter the suction cups are released to permit the carton to assume its original configuration and the conveyor is operated to move the carton to a detecting station at which point a detector device generally identified by the reference numeral 212 is provided for the purposes of determining whether or not the carton contains a package 205. The signal which is generated by the detecting device 212 serves to activate the discharge cylinder 214 as will be described hereinafter. In the next station illustrated in FIG. 1 of the drawings, a cvlinder 216 is operable to drive a suction cup 218 into and out of engagement with the flange 204, engages the flange 204 and pulls the flange inwardly to provide a narrow gap between the package 205 and the side wall of the carton to facilitate the introduction of a discount coupon or the like into the space provided between the side wall of the carton and the package. Thereafter, the uoper end of the package is closed by initially plowing the leading end flap 198 into a folded position by engagement with the hoId down rail 220. The trailing flap 200 is then folded over by engagement with the kicker plate 220.

A layer of adhesive is applied in the form of a wide band 224 to each of the flaps 198 and 200 by means of glue nozzles 222. Plow bars 226 are arranged above and below the conveyor and serve to fold the first side flaps 202 inwardly to contact the band of adhesive 224 to be secured with respect to the flaps 198 and 200. A second set of glue nozzles 228 is provided for applying a layer of adhesive to the outer surfaces of the first flaps 202 along the inner edge thereof. A second plowing device in the form of a blade 230 is provided for the purposes of plowing the second flaps to a position overlying the first flaps to be adhesively secured thereto. As shown in FIG. 1 of the drawings, the plow blade 230 is mounted on a shaft 232 and can be rotatably driven by rotating the shaft 232 so that rather than merely being held stationary as the carton moves under the plow blade 232, it can be activated to rotate from its stationary position shown in FIG. 1 in the direction of the arrow 234 to complete the folding of the flap of the carton even in circumstances where the movement of the conveyor is interrupted because of a shutdown, thus ensuring that the second flaps 204 are folded into a face-to-face relationship with respect to the underlying first flap 202 to be adhesively secured thereto before the adhesive which is applied by the nozzle 228 has an opportunity to dry out and become ineffective. This prevents a situation where a portion of the top flap 204 may not be completely secured with respect to the underlying flap 202. In circumstances where the seal between the flaps 202 and 204 does not appear to be complete, the purchaser of the package may be inclined to suspect that the package has been tampered with and by ensuring that the closing operation is completed even in circumstances when the movement of the conveyor is otherwise interrupted, the difficulties previously encountered with respect to obtaining a proper seal are overcome.

The loaded cartons are then transported to the discharge station with the closed ends being retained in a closed position by hold-down rails 236. When the cartons enter the discharge station 16, either one of two discharge cylinders 214 or 238 is activated. The cylinder 214 will be activated if the detector device 212 has detected the absence of a package 205 with the result that the carton 190 which is discharged by the cylinder 214 is an empty carton. If the carton is a loaded carton, it is then discharged by activating the cylinder 238 to cause the pusher device 240 to push the loaded carton out of the receptacle 20 into any convenient receiving device.

The power transmission mechanism will now be described with reference to FIG. 12 of the drawings.

As shown in FIG. 12, the main drive motor 242 is connected to a gear box 244 which has an output pulley 246. The output pulley 246 is connected by means of a belt 248 to a pulley 250 which is mounted on the main drive shaft 252. The main drive shaft 252 is mounted for rotation in bearings 254 which are supported by beams 256 of the main frame. The power to drive the chains 68 of the main conveyor is taken from the main drive shaft 252 by means of a pulley 258 which is connected by means of a belt 260 to the input pulley 262 of a breaking unit 264. The breaking unit 264 serves to provide intermittent breaking of the main conveyor. The output shaft 266 is connected to the input shaft of a gearbox 268 by means of a coupling 270. An output sprocket 272 connects the output of the gearbox 268 to the drive shaft 267 by means of a chain 274 and a sprocket 276. The kicker blade 220 is drivingly connected to the shaft 252 by means of a sprocket 278, chain 280, sprocket 282, gearbox 284, sprocket 286, chain 288 and sprocket 290. The kicker 206 is drivingly connected to the main drive shaft 252 by means of a sprocket 292 which is connected to a further sprocket 294 by means of a chain 296. A pulley 298 is mounted on the same shaft as the sprocket 294 and a second pulley 300 is mounted on a shaft 302 and connected to the first pulley 298 by means of a belt 304. A pulley 306 is connected to a pulley 308 by means of a belt 310. The pulley 308 is mounted on the shaft 312 upon which the kicker blade 206 is also mounted. The shafts 302 and 312 can be raised or lowered to permit adjustment of the position of the kicker blade 206 as required in use.

The power takeoff for the carton opening mechanism includes a gearbox 314 which is connected to one end of the main drive shaft 252. The gearbox 314 is connected to a sprocket 316 by means of a chain 318 which also extends over a tensioning sprocket 320. The sprocket 316 is mounted on a shaft 322 upon which the transfer mechanism drive assembly 324 is mounted. This mechanism is described in U.S. Pat. No. 3,937,458 and will not therefore be described in detail.

With reference to FIG. 8 of the drawings, the reference numeral 400 has been applied to a line which illustrates the datum plates which remains fixed regardless of the height H of the carton which is to be loaded. The position of the various mechanisms which are used for the purposes of closing the bottom flaps are adjusted in height in relation to the datum plane 400 in order to accommodate cartons of different height. The datum plane 400 is maintained in a fixed position with respect to the stationary main frame and all of the height adjustments are made by adjusting the height of the secondary frame.

Adjustment of the height of the secondary frame is achieved by rotatably driving one of the jacking screws 114 by engaging the square end portion 126 thereof by means of any convenient wrench and rotating the jacking screw. Rotation of the jacking screw in one direction will cause the threaded portion 118 to rotate with respect to the nut 46. The sprocket 132 is fixed with respect to the jacking screw 114 and the chain 144 connects each of the sprockets 132 with the result that rotation of one of the jacking screws 114 causes rotation of all of the jacking screws thereby to raise or lower the secondary frame in the direction of the arrows 402 to provide an even adjustment of the height of the secondary frame with respect to the datum plane 400 and thereby cause an even adjustment of the height of the first and second retainer rails 28 and 30 with respect to the datum plane 400. Thus, it will be seen that merely by operating one of the jacking screws, it is possible to obtain height adjustment of all of the components which are carried by the secondary frame with respect to the datum plane 400.

As indicated in FIG. 4 of the drawings, the vertical datum plane 500 is the position assumed by the back wall 194 of a carton located in the receptacle 20. Lateral adjustment of the first and second retainer bars 28 and 30 is simultaneously obtained as previously described by rotatably driving one of the pinions 142 on the stem portion 124 thereby to simultaneously activate all of the rack members 146 and 148 to provide the required lateral adjustment. Lateral adjustment is made when the front to back width W of the carton is to be varied.

From the foregoing it will be apparent that the carton loading mechanism of the present invention provides a simple and efficient mechanism for simplifying the adjustment of the various components of the carton closure device which must be adjusted to accommodate cartons of different proportions.

We claim:

1. In a carton loading machine in which cartons are vertically oriented and upwardly open when loading, the loading machine having a carton receiving station and a carton discharge station, the improvement of;

(a) an endless carton conveyor extending in a generally horizontal plane along an endless path from the receiving station to the discharge station and back to the receiving station, (b) a plurality of carton receptacles mounted on said endless conveyor for movement therewith along said path, each receptacle having an open front end opening laterally from said path, (c) a plurality of first retainer members arranged in an overlapping end-to-end relationship extending along said path between said receiving station and said discharge station and disposed opposite the open ends of said receptacles for retaining an open carton in said receptacles in use, (d) mounting means mounting said first retainer members for simultaneous movement of said first retainer members with respect to said receptacles for movement toward and away from the open front ends thereof to accommodate cartons of different front to back width.

2. A carton loading machine as claimed in claim 1, wherein said receptacles have an open bottom end to accommodate cartons of different lengths, said carton loading machine further comprising;

(a) a plurality of second retainer members arranged in an overlapping end-to-end relationship, said retainer members being mounted on said mounting means, said mounting means being height adjustable to effect simultaneous adjustment of the height of said second retainer members with respect to the open bottom ends of said receptacles.

3. A carton loading machine as claimed in claim 1, wherein said endless path has four straight lengths interconnected by rounded corners so as to be generally quadralateral in shape in plan view, said first retainer members having their opposite ends curved and overlapping one another opposite the rounded corners of the quadralateral shaped path.

4. A carton loading machine as claimed in claim 1, comprising a main frame, said endless conveyor means being mounted on said main frame such that the shape and proportions of said endless paths are fixed.

5. In a carton loading machine in which cartons are vertically oriented and upwardly open when loading, the loading machine having a carton receiving station and a carton discharge station, the improvement of a carton conveyor system comprising;

(a) a main frame, (b) an endless conveyor mounted on the main frame and extending in a generally horizontal plane along an endless path from the receiving station to the discharge station and back to the receiving station, (c) a plurality of carton receptacles mounted on said endless conveyor for movement therewith along said path, each receptacle having an open front end opening laterally from said path and an open bottom end opening downwardly from said conveyor, (d) a secordary frame, (e) first mounting means mounting said secondary frame onto the main frame for relative movement with respect to the main frame so as to be adjustable in height with respect to said conveyor (f) first retainer means spaced laterally from and disposed opposite said conveyor for laterally retaining items on said conveyor, (g) second mounting means mounting said first retainer means on said secondary frame for simultaneous lateral adjustment with respect to said conveyor means to accomodate items of lateral proportion, (h) second retainer means carried by said secondary frame and located below the open bottom ends of said recepticles between said loading and discharge stations, said second retainer means moving with said secondary frame in response to operation of said first mounting means to vary the height of the secondary retainer means with respect to said conveyor to accomodate items of different height carried by said conveyor.

6. A carton loading machine as claimed in claim 5 wherein said first mounting means comprises;

(a) a plurality of jacking assemblies located at spaced locations about said main frame and means interconnecting said jacking assemblies to effect simultaneous operation thereof to achieve similtaneous adjustment of said the vertical position of said first and second retainer means as aforesaid.

7. A carton loading machine as claimed in claim 6 wherein each jacking assembly comprises;

(a) a jacking screw component, (b) a jacking nut component, said jacking nut component threadedly receiving a jacking screw component, (c) one of said components being mounted on said main frame and the other of said components being mounted on said secondary frame.

8. A carton loading machine as claimed in claim 7 wherein said first mounting means further comprises power transmission means interconnecting each of the components of one type such that rotation of one causes rotation of all of the components of the same type thereby to raise or lower the secondary frame as required to adjust the position of the first and second retainer means with respect to the conveyor.

9. A carton loading machine as claimed in claim 8 wherein said power transmission means comprises;

a sprocket mounted on each of said components of one set of components and a chain drivingly engaging each of said sprockets.

10. A carton loading machine as claimed in claim 5 wherein said second mounting means comprises;

rack and pinion members interconnecting said first retainer means and said secondary frame.

11. A carton loading machine as claimed in claim 10 wherein said rack members are mounted on said first retainer means and said pinion members are mounted on said secondary frame.

12. A carton loading machine as claimed in claim 11 wherein said first retainer means comprises a plurality of support members which are arranged in an end to end relationship, a set of two of said rack members being mounted on each guide rail and extending parallel to one another, one rack member of set of rack members being located adjacent a rack member of an adjacent guide rail to provide adjacent pairs of rack members, the rack members of each adjacent pair being meshed with a single pinion such that all of the rack and pinion members are drivingly interconnected so that rotation of one of said pinions causes all of the guide members to move laterally simultaneously with respect to said conveyor.

13. In a carton loading machine in which cartons are vertically oriented and upwardly open when loading, the loading machine having a carton receiving station and a carton discharge station, the improvement of a carton conveyor system comprising;

(a) a main frame having a generally quadrilateral shape in plan view, (b) an endless conveyor mounted on the main frame and extending in a generally horizontal plane along an endless path from the receiving station to the discharge station and back to the receiving station, said endless path having four straight lengths interconnected by rounded corners so as to correspond to the generally quadralateral shape of the main frame, (c) a plurality of carton receptacles mounted on said endless conveyor for movement therewith along said path, each receptacle having an open front end opening laterally from said path and an open bottom end opening downwardly from said conveyor, (d) a secondary frame having a generally quadrilateral shape in plan view corresponding to the that of the main frame (e) a jacking screw component mounted for rotation at each corner of said secondary frame, (f) a jacking nut mounted for rotation at each corner of said main frame, each jacking nut threadedly receiving a jacking screw so as to mount said secondary frame for vertical movement with respect to said main frame so as to be adjustable in height with respect to said conveyor, (g) a sprocket mounted on each jacking screw, (h) a chain drivingly engaging each of said sprockets such that rotation of one jacking screw causes rotation of all of the jacking screws to evenly adjust the height of the secondary frame, (i) a support member extending along each side of said secondary frame, (j) a rack member located at each end of each support member, the rack members of each support member extending parallel to one another and forming a set, (k) a pinion member mounted for free rotation on each of said jacking screws, (l) one rack member of each set of rack members being located adjacent a rack member of an adjacent guide rail to provide adjacent pairs of rack members, the rack members of each adjacent pair being meshed with one of said pinions such that all of the rack and pinion members are drivingly interconnected so that rotation of one of said pinions causes all of the support members to move laterally simultaneously with respect to said conveyor (m) a first retainer member mounted on each support member and spaced laterally from and disposed opposite said open front ends of said recepticles for laterally retaining items in said recepticles, said first retainer means moving with said support means both laterally and vertically so as to adjust all of the first retainers simultaneously as required in use, (n) second retainer means mounted on each support member and located below the open bottom ends of said recepticles to provide underlying support for items in said recepticles, as they travel between said loading and discharge stations, said second retainer means moving with said secondary frame in response to operation of said jacking screws to vary the height of the second retainer means with respect to said conveyor to accomodate items of different height carried by said conveyor.

* * * * *